US011053628B2

(12) United States Patent
Alarcon et al.

(10) Patent No.: US 11,053,628 B2
(45) Date of Patent: Jul. 6, 2021

(54) WATER SUPPLY CIRCUIT FOR A LAUNDRY TREATING APPLIANCE

(71) Applicant: WHIRLPOOL CORPORATION, Benton Harbor, MI (US)

(72) Inventors: Celso Andres Alarcon, Monterrey (MX); Marcus A. Cannon, Saint Joseph, MI (US); Emmanuel F. Gonzaga, Rio Claro (BR); Guy Stormo, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 319 days.

(21) Appl. No.: 15/643,687

(22) Filed: Jul. 7, 2017

(65) Prior Publication Data

US 2019/0010654 A1 Jan. 10, 2019

(51) Int. Cl.

| | |
|---|---|
| ***D06F 39/02*** | (2006.01) |
| ***D06F 39/08*** | (2006.01) |
| ***D06F 37/12*** | (2006.01) |
| ***D06F 13/00*** | (2006.01) |
| ***D06F 33/00*** | (2020.01) |
| ***D06F 34/28*** | (2020.01) |

(52) U.S. Cl.

CPC ..... *D06F 39/028* (2013.01); *D06F 13/00* (2013.01); *D06F 33/00* (2013.01); *D06F 34/28* (2020.02); *D06F 37/12* (2013.01); *D06F 39/088* (2013.01); *D06F 39/02* (2013.01); *D06F 2202/04* (2013.01); *D06F 2204/088* (2013.01); *D06F 2214/00* (2013.01)

(58) Field of Classification Search

CPC ..... D06F 39/028; D06F 39/088

See application file for complete search history.

(56) References Cited

U.S. PATENT DOCUMENTS

| | | | | |
|---|---|---|---|---|
| 5,345,637 | A | 9/1994 | Pastryk et al. | |
| 5,605,173 | A | 2/1997 | Arnaud | |
| 7,587,916 | B2 * | 9/2009 | Rizzetto | D06F 39/028 68/17 R |
| 7,650,765 | B2 | 1/2010 | Rizzetto | |
| 8,196,441 | B2 | 6/2012 | Hendrickson et al. | |
| 8,388,695 | B2 | 3/2013 | Hendrickson et al. | |
| 8,397,328 | B2 | 3/2013 | Hendrickson et al. | |
| 8,397,544 | B2 | 3/2013 | Hendrickson | |

(Continued)

FOREIGN PATENT DOCUMENTS

| | | |
|---|---|---|
| CN | 102269284 A | 12/2011 |
| DE | 4335600 A1 | 4/1994 |

(Continued)

OTHER PUBLICATIONS

DE10324352—Machine Translation (Year: 2004).*

European Search Report for Counterpart EP18180248.9, dated Oct. 10, 2018.

*Primary Examiner* — Marc Lorenzi

(74) *Attorney, Agent, or Firm* — McGarry Bair PC

(57) ABSTRACT

A laundry treating appliance and method of operating a laundry treating appliance includes a treating chamber receiving laundry for treating, a dispenser fluidly coupled to the treating chamber and a faucet. A water supply circuit includes a hot water inlet and a cold water inlet supplying hot water, cold water, or a mixture of hot and cold water to the faucet.

18 Claims, 5 Drawing Sheets

(56) References Cited

U.S. PATENT DOCUMENTS

| | | | | |
|---|---|---|---|---|
| 8,438,881 | B2 | 5/2013 | Ihne et al. | |
| 8,813,526 | B2 | 8/2014 | Doyle et al. | |
| 2005/0262881 | A1* | 12/2005 | Rizzetto | D06F 39/028 68/3 R |
| 2007/0084000 | A1 | 4/2007 | Bernardino et al. | |
| 2007/0220927 | A1* | 9/2007 | Rizzetto | D06F 39/028 68/16 |
| 2012/0060876 | A1* | 3/2012 | Tarr | A47L 15/0023 134/56 R |
| 2016/0047078 | A1* | 2/2016 | Leibman | D06F 39/028 8/137 |
| 2016/0060800 | A1 | 3/2016 | Ghosh et al. | |
| 2016/0289884 | A1* | 10/2016 | Kim | D06F 39/088 |
| 2017/0204553 | A1* | 7/2017 | Leibman | D06F 39/02 |
| 2017/0298560 | A1* | 10/2017 | Leibman | D06F 39/022 |
| 2018/0340288 | A1* | 11/2018 | Kim | D06F 1/02 |

FOREIGN PATENT DOCUMENTS

| | | | | |
|---|---|---|---|---|
| DE | 4304382 | A1 | 8/1994 | |
| DE | 10324352 | A1 * | 12/2004 | D06F 39/028 |
| DE | 10324352 | A1 | 12/2004 | |
| DE | 202005019491 | U1 | 2/2006 | |
| EP | 2820996 | A1 | 1/2015 | |
| EP | 3000926 | A1 | 3/2016 | |
| JP | S58200789 | A | 11/1983 | |

* cited by examiner

WATER SUPPLY CIRCUIT FOR A LAUNDRY TREATING APPLIANCE

BACKGROUND

Laundry treating appliances, such as washing machines, typically include a rotatable drum defining a treating chamber in which laundry items are placed for treatment according to an automatic cycle of operation implemented by the appliance. Liquid, such as water or a mixture of water and one or more treatment aids, is supplied to the treating chamber during the automatic cycle of operation to treat the laundry. The liquid is collected within a tub surrounding the drum and is either drained from the appliance or recirculated for application to the laundry items.

In some scenarios, it may be desirable to treat a laundry item by hand prior to or instead of treating the laundry item according to an automatic cycle of operation. The laundry treating appliance may include a faucet for dispensing water that is accessible by a user for pre-treating or hand washing a laundry item. The water dispensed by the faucet can be collected in the tub for subsequent draining from the appliance.

SUMMARY

In one aspect, a laundry treating appliance and method of operating a laundry treating appliance includes a treating chamber receiving laundry for treatment, a dispenser having at least first and second treating chemistry reservoirs fluidly coupled to the treating chamber, and a faucet. A water supply circuit includes a hot water inlet and a cold water supply supplying at least one of hot or cold water to the first and second treating chemistry reservoirs and hot water, cold water, or a mixture of hot and cold water to the faucet.

DESCRIPTION

Figure 1:
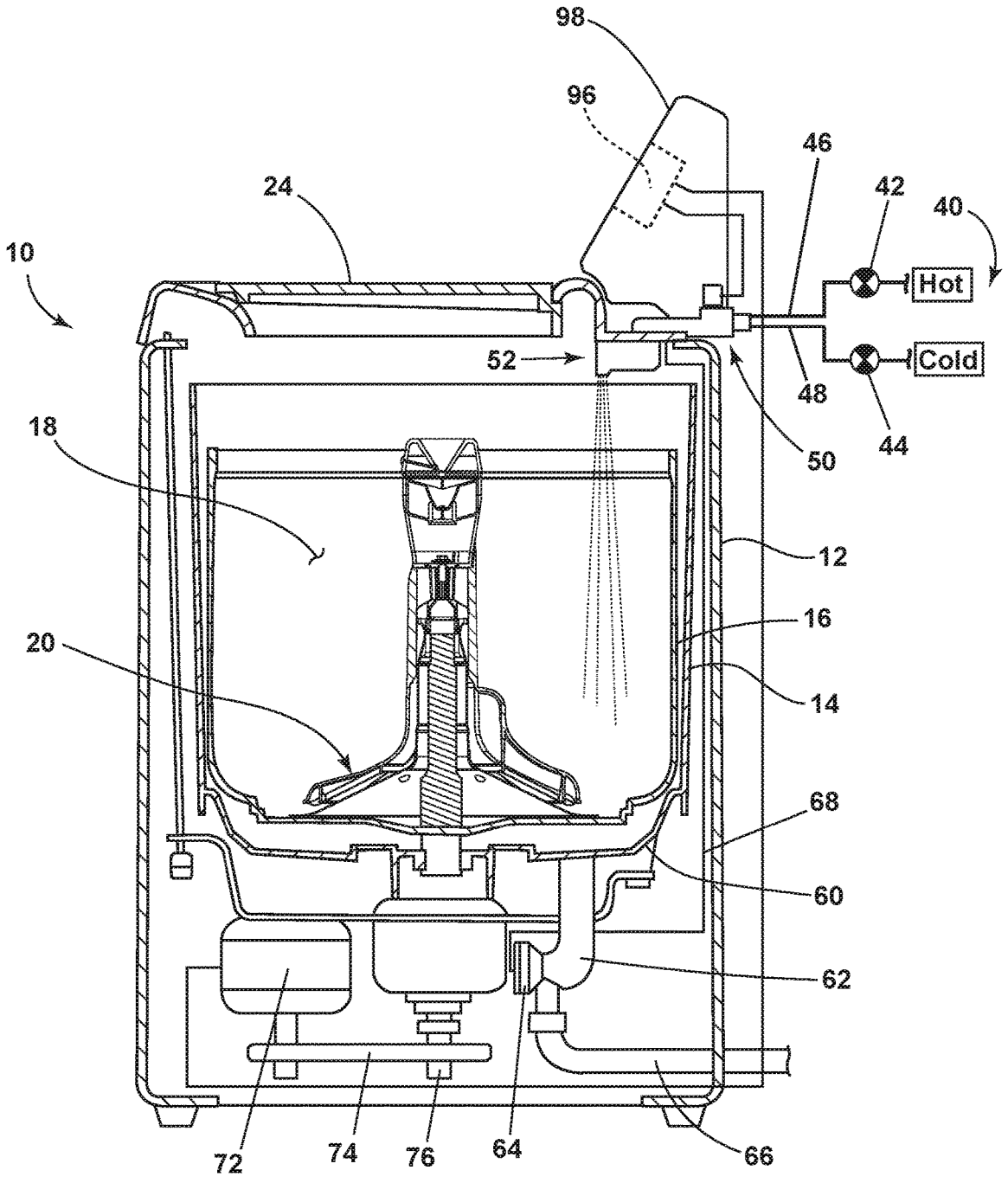
FIG. 1 is a schematic view of a laundry treating appliance in the form of a washing machine according to the present disclosure.

FIG. 1 is a schematic view of a laundry treating appliance according to a first embodiment. The laundry treating appliance may be any appliance which performs a cycle of operation to clean or otherwise treat items placed therein, non-limiting examples of which include a horizontal or vertical axis clothes washer or washing machine; a combination washing machine and dryer; a tumbling or stationary refreshing/revitalizing machine; an extractor; a non-aqueous washing apparatus; and a revitalizing machine.

As used herein, the term "vertical axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

FIG. 1 is a schematic view of a laundry treating appliance in the form of a vertical axis washing machine. While aspects of the present disclosure are described in the context of a vertical axis washing machine, it will be understood that the embodiments may be used with a horizontal axis washing machine in a similar manner. Still referring to FIG. 1, the laundry treating appliance is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the aspects of the present disclosure.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations (not shown) such that liquid may flow between the tub 14 and the drum 16 through the perforations. It is also within the scope of the present disclosure for the laundry holding system to comprise only a tub with the tub defining the laundry treating chamber. A rotatable clothes mover 20 may be provided within the treating chamber 18 for imparting mechanical energy to the laundry items during a cycle of operation. The clothes mover 20 may be an agitator, impeller, nutator, or the like for imparting mechanical energy to the laundry items. The laundry holding system may further include a door 24 which may be movably mounted to the cabinet 12 to selectively close both the tub 14 and the drum 16.

The washing machine 10 may further include a liquid supply system for supplying water to the washing machine 10 for use in treating laundry during a cycle of operation. The liquid supply system may be fluidly coupled to a source of water, such as a household water supply 40, through separate valves 42 and 44 for controlling the flow of hot and cold water, respectively. Water may be supplied through hot and cold water inlet conduits 46 and 48 directly to the tub 14 or to a water supply circuit 50 for distribution to one or more components of the washing machine 10.

The washing machine 10 may also be provided with a dispensing system for dispensing treating chemistry to the treating chamber 18 for use in treating the laundry according to a cycle of operation. The dispensing system may include a dispenser 52 which may be a single use dispenser, a bulk dispenser or a combination of a single and bulk dispenser. Non-limiting examples of suitable dispensers are disclosed in U.S. Pat. No. 8,196,441 to Hendrickson et al., filed Jul. 1, 2008, entitled "Household Cleaning Appliance with a Dispensing System Operable Between a Single Use Dispensing System and a Bulk Dispensing System," U.S. Pat. No.

8,388,695 to Hendrickson et al., filed Jul. 1, 2008, entitled "Apparatus and Method for Controlling Laundering Cycle by Sensing Wash Aid Concentration," U.S. Pat. No. 8,397,328 to Hendrickson et al., filed Jul. 1, 2008, entitled "Apparatus and Method for Controlling Concentration of Wash Aid in Wash Liquid," U.S. Pat. No. 8,813,526 to Doyle et al., filed Jul. 1, 2008, entitled "Water Flow Paths in a Household Cleaning Appliance with Single Use and Bulk Dispensing," U.S. Pat. No. 8,397,544 to Hendrickson, filed Jun. 23, 2009, entitled "Household Cleaning Appliance with a Single Water Flow Path for Both Non-Bulk and Bulk Dispensing," and U.S. Pat. No. 8,438,881, filed Apr. 25, 2011, entitled "Method and Apparatus for Dispensing Treating Chemistry in a Laundry Treating Appliance," which are herein incorporated by reference in full.

Regardless of the type of dispenser used, the dispenser 52 may be configured to dispense a treating chemistry directly to the tub 14 or treating chamber 18 or mixed with water from the liquid supply system through a suitable dispensing nozzle (not shown). The dispensing nozzle may be configured to dispense the treating chemistry into the tub 14 or treating chamber 18 in a desired pattern and under a desired amount of pressure, the details of which are not germane to the present disclosure.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to treating chamber 18 typically enters a space between the tub 14 and the drum 16 and may flow by gravity to a sump 60 formed in part by a lower portion of the tub 14. The sump 60 may also be formed by a sump conduit 62 that may fluidly couple the lower portion of the tub 14 to a pump 64. The pump 64 may direct liquid to a drain conduit 66, which may drain the liquid from the washing machine 10, or to a recirculation conduit 68, which may direct the liquid from the sump 60 into the drum 16. The recirculation conduit 68 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, the details of which are not germane to the present description. Non-limiting examples of heating systems include a steam generator and a sump heater. Additionally, the liquid supply, recirculation, drain systems may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 72, which may be directly coupled with the drum 16 through a belt 74 and a drive shaft 76 to rotate the drum 16, as is known in the art. Alternatively, the motor may be a brushless permanent magnet (BPM) motor, an induction motor, or a permanent split capacitor (PSC) motor. The motor 72 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
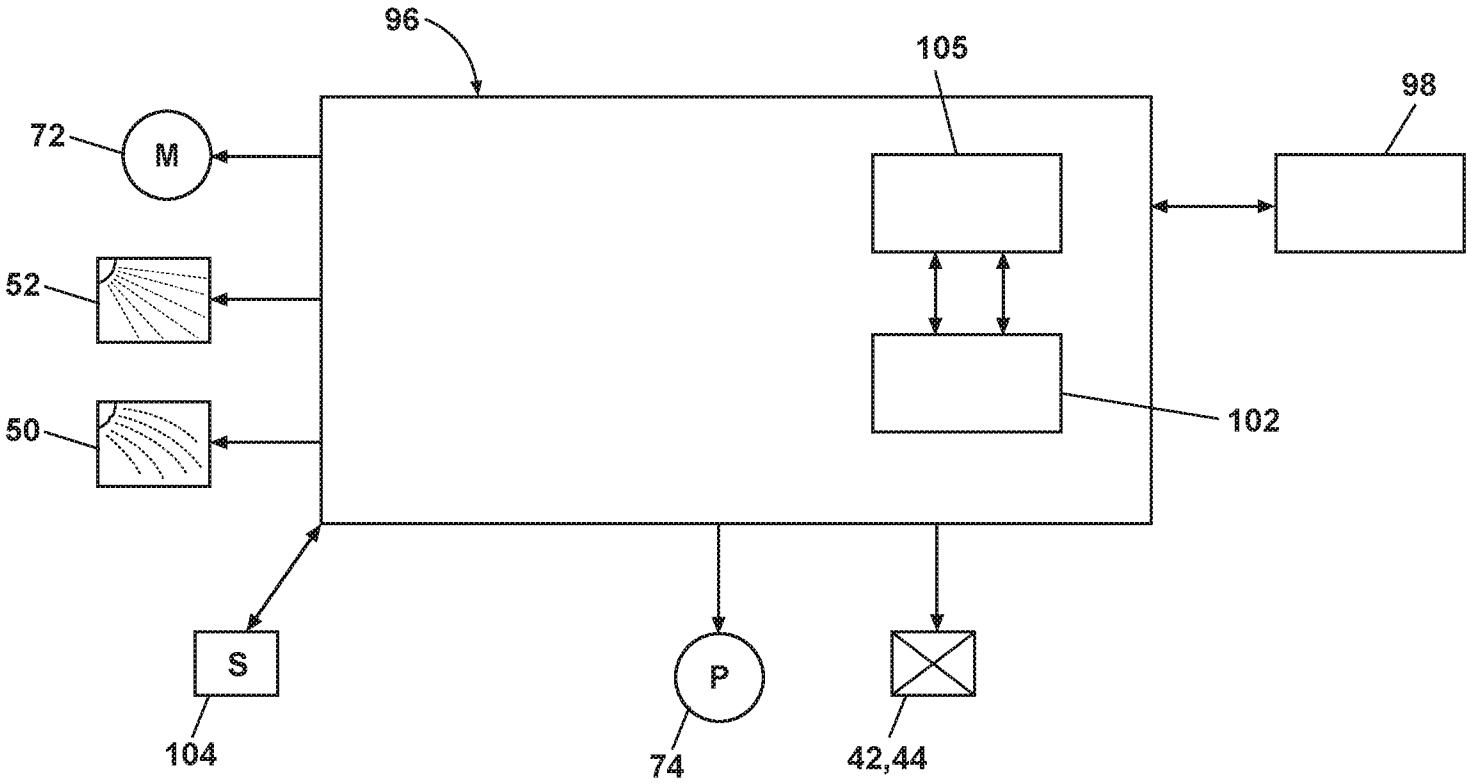
FIG. 2 is a schematic view of a control system of the laundry treating appliance of FIG. 1 according to the present disclosure.

As illustrated in FIG. 2, the controller 96 may be provided with a memory 105 and a central processing unit (CPU) 102. The memory 105 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 105 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 72, the pump 64, the dispenser 52, a steam generator, and a sump heater to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

Figure 3:
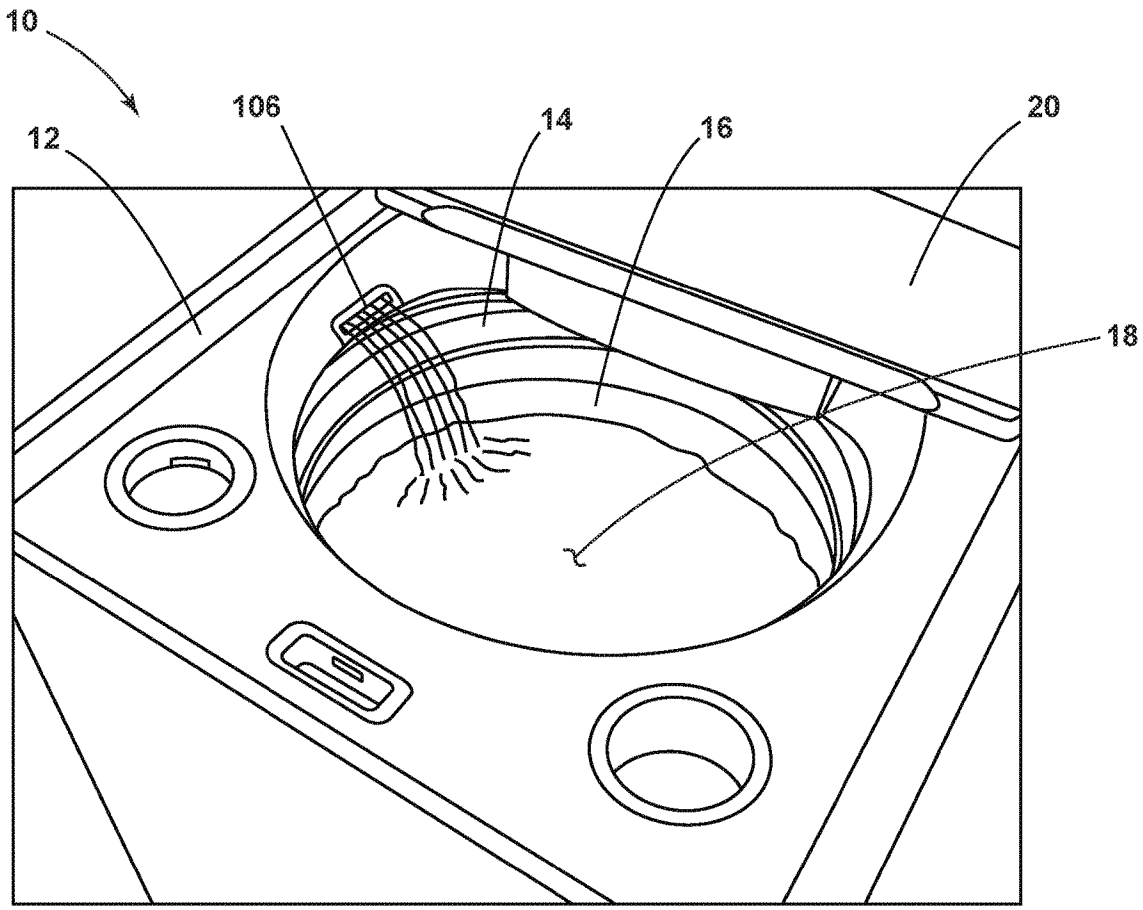
FIG. 3 is a perspective view of a portion of a laundry treating appliance according to the present disclosure.

Referring now to FIG. 3, the water supply circuit 50 includes a faucet 106 configured to selectively dispense water for use independent of a cycle of operation. The faucet 106 is fluidly coupled with the household water supply 40 for dispensing water into the treating chamber 18 in a manner that is accessible to a user of the washing machine 10 when the door 24 is opened. The faucet 106 may be supported by at least one of the cabinet 12 and/or the tub 14 and is configured to dispense the water through an open top of the tub 14 and the drum 16 and into the treating chamber 18. The faucet 106 is configured to supply a flow of water for use in treating a laundry item independent from an automatic cycle of operation implemented by the washing machine 10. For example, a user may wish to rinse a laundry item before washing in an automatic cycle of operation or hand wash the item. The faucet 106 may be configured to supply a flow of water as a stream, a spray, a drip, or any other suitable flow pattern. The faucet 106 may supply a fixed flow pattern of water or be configured to allow a user to select a desired flow pattern.

Figure 4:
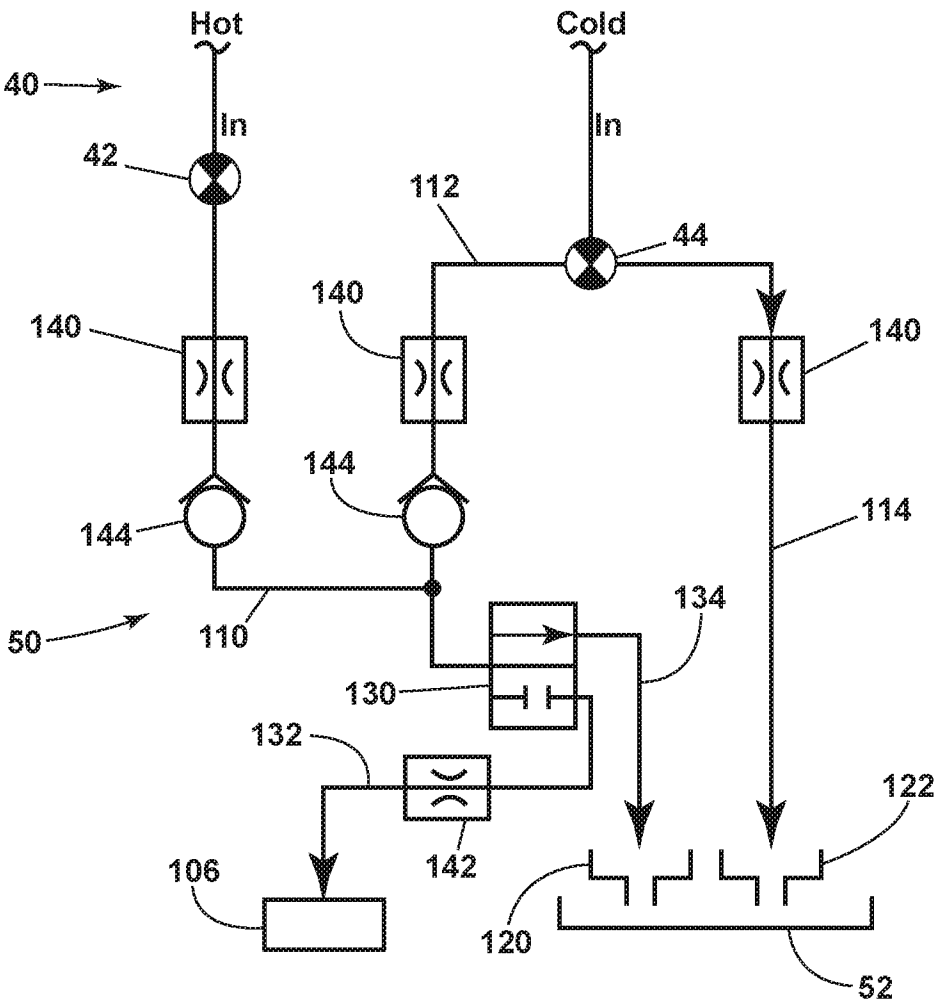
FIG. 4 is a schematic view of a water supply circuit for use with the laundry treating appliance of FIG. 1 according to the present disclosure.

Referring now to FIG. 4, an exemplary water supply circuit 50 is illustrated. The water supply circuit 50 can be fluidly coupled with the household water supply 40 for selectively providing hot and/or cold water to the dispenser 52 or to the faucet 106. The water supply circuit 50 can include a hot water supply conduit 110, a first cold water supply conduit 112, and a second cold water supply conduit 114. The hot water supply conduit 110 and the first cold water supply conduit 112 can be fluidly coupled with the faucet 106 and at least a first treating chemistry reservoir 120 of the dispenser 52 to supply water at a predetermined temperature to the faucet 106 and/or the first treating chemistry reservoir 120. The second cold water supply conduit 114 can be coupled with a second treating chemistry reservoir 122 of the dispenser 52 and/or directly to the tub 14 to provide cold water to the second treating chemistry reservoir 122 and/or the tub 14.

In the example embodiment illustrated in FIG. 4, the first treating chemistry reservoir 120 can be a detergent dispenser and the second treating chemistry reservoir 122 can be configured to dispense an optional treatment aid, such as a fabric softener, a whitener, or a pre-treatment aid. Alternatively, the second cold water conduit 114 can be fluidly coupled with the tub 14 rather than the second treating chemistry reservoir 122 and the second treating chemistry reservoir 122 may be an optional component. In another example, additional cold water supply conduits can be provided for supplying cold water to one or more additional or alternative components of the washing machine 10, non-limiting examples of which include additional dispenser components and a steam generator. While the embodiment of FIG. 4 is described in the context of a dispenser 52 having a first treating chemistry reservoir 120 and a second treating chemistry reservoir 122, respectively, it will be understood that the water supply circuit 50 can be used in a similar manner with a dispenser having only a single reservoir or more than two reservoirs.

The water supply circuit 50 can include a diverter valve 130 fluidly coupled with the hot water supply conduit 110 and the first cold water supply conduit 112. The diverter valve 130 is configured to selectively supply hot and/or cold water to the faucet 106 through a faucet supply conduit 132 and/or the first treating chemistry reservoir 120 through a detergent supply conduit 134. The controller 96 can be operably coupled to the diverter valve 130 to control the flow of water to the faucet 106 and the first treating chemistry reservoir 120. For example, the controller 96 can control the diverter valve 130 to supply water to the first treating chemistry reservoir 120 according to a selected cycle of operation. In another example, the controller 96 can control the diverter valve 130 to supply water to the faucet 106 independent of a cycle of operation, at the request of a user.

The water supply circuit 50 can include additional optional components for controlling the flow of water through the system. For example, each of the hot water supply conduit 110 and first and second cold water supply conduits 112 and 114 can include a flow restrictor 140 to control a flow rate of water through each conduit. Flow restrictors 140 can be configured to provide the same or a different flow rate through each of the hot water supply conduit 110 and first and second cold water supply conduits 112 and 114. The faucet supply conduit 132 can optionally include a flow restrictor 142, which may be the same or different than the flow restrictor 140. Fewer or additional flow restrictors may be used as desired. In one example, the flow restrictor 142 is configured to provide a slower flow rate than the flow restrictors 140 on the hot water supply conduit 110 and first and second cold water supply conduits 112, 114. In another example, the hot water supply conduit 110 and first and second cold water supply conduits 112, 114 are restricted to a flow rate of about 8 liters per minute and the faucet supply conduit 132 is restricted to a flow rate of about 1 liter per minute.

One or more check valves 144 may optionally be included, as desired, to prevent water from back flowing to the hot and cold water valves 42, 44. For example, check valves 144 may be included on the hot water supply conduit 110 and the first cold water supply conduit 112.

One or more temperature sensors (not shown) may be provided for determining a temperature of the water supplied to the faucet 106 and/or the first treating chemistry reservoir 120. The temperature sensor may be any suitable type of sensor for determining a temperature of the water flowing the supply conduits. Non-limiting examples of temperature sensors include various types of thermocouples, thermometers, or a mechanical thermostats, such as a positive temperature coefficient (PTC) thermistor or a negative temperature coefficient (NTC) thermistor. The temperature sensor(s) may be communicably coupled with the controller 96 to provide information to the controller 96 regarding the temperature of the water flowing through the associated conduit. The controller 96 may be programmed to receive the temperature information as input to a data table or algorithm for determining a ratio of hot and cold water to supply from the household water supply 40 to provide water at a predetermined temperature. The controller 96 may be programmed to control the hot water supply valve 42 and the cold water supply valve 44 to provide the desired ratio of hot and cold water.

In one example, controller 96 is programmed to control the hot water supply valve 42 and the cold water supply valve 44 to provide water to the first treating chemistry reservoir 120 at a predetermined temperature according to an automatic cycle of operation selected by the user through the user interface 98. In another example, the controller 96 is programmed to control the hot water supply valve 42 and the cold water valve 44 to provide water to the faucet 106 at a predetermined temperature selected by the user through the user interface 98. In still another example, the controller 96 is programmed to supply water to either or both of the first treating chemistry reservoir 120 and the faucet 106 at a predetermined temperature based on input received through the user interface 98.

The water supply circuit 50 allows a user to utilize the faucet 106 to dispense hot, cold, or warm water (a mixture of hot and cold water) independent of an automatic cycle of operation implemented by the washing machine 10. In this manner, the faucet 106 can be used to pre-treat, rinse, or hand-wash a laundry item, for example. The water supply circuit 50 also supplies hot, cold, or warm water to the dispensing system for use in implementing a selected automatic cycle of operation.

Still referring to FIG. 4, a user can select an automatic cycle of operation through the user interface 98 and the controller 96 is configured to control the components of the washing machine 10 to implement the selected cycle of operation. When the selected cycle of operation calls for water to be supplied to the first treating chemistry reservoir 120, the controller 96 controls the hot water supply valve 42 to supply hot water to the hot water supply conduit 110 and/or controls the cold water valve 44 to supply cold water to the first cold water supply conduit 112.

If the selected automatic cycle of operation calls for only cold water to be supplied to the first treating chemistry reservoir 120, then only the cold water valve 44 is actuated. If the selected automatic cycle of operation calls for only hot water to be supplied to the first treating chemistry reservoir 120, then only the hot water supply valve 42 is actuated. If the selected automatic cycle of operation calls for warm water, both the hot water supply valve 42 and the cold water valve 44 are actuated. The controller 96 can be programmed to control the ratio of hot and cold water according to a predetermined algorithm and/or based on data received from a temperature sensor configured to determine the temperature of water supplied to the first treating chemistry reservoir 120.

The hot and/or cold water flows through the hot water supply conduit 110 and/or the first cold water supply conduit 112 to the diverter valve 130. The controller 96 can control the diverter valve 130 to direct the water to the detergent supply conduit 134 through which the water is ultimately supplied to the first treating chemistry reservoir 120 for use during the selected automatic cycle of operation. The diverter valve 130 is configured to allow the hot and cold water to mix prior to supplying the water to the detergent supply conduit 134. When the selected automatic cycle of operation calls for water to be supplied to the second treating chemistry reservoir 122, the controller 96 actuates the cold water valve 44 to supply water to the second cold water supply conduit 114, which supplies the cold water to the second treating chemistry reservoir 122.

Still referring to FIG. 4, to use the faucet 106, the user provides input to the controller 96 through the user interface 98 (FIG. 1) to actuate the faucet 106. The user interface 98 can include a touch screen, push button, knob, or dial which the user can manipulate to turn the faucet 106 on and off independent of selecting an automatic cycle of operation. Optionally, the user interface 98 can be configured to receive input regarding a desired temperature of water to be dispensed by the faucet 106. The user interface 98 can be configured to allow the user to select a desired temperature within a predetermined range of temperatures or to select a temperature from a set of predetermined options, such as hot, cold, and warm. The controller 96 can be programmed to control the ratio of hot and cold water according to a predetermined algorithm and/or based on data received from a temperature sensor configured to determine the temperature of water supplied to the faucet 106.

To supply water to the faucet 106, the controller 96 controls the hot water supply valve 42 to supply hot water to the hot water supply conduit 110 and/or controls the cold water valve 44 to supply cold water to the first cold water supply conduit 112 based on the temperature selected by the user. The controller 96 actuates the diverter valve 130 to supply water flowing through the hot water supply conduit 110 and/or the first cold water supply conduit 112 to the faucet supply conduit 132, which is subsequently dispensed through the faucet 106. The optional flow restrictor 142 can be configured to restrict the flow rate of the dispensed water to a flow rate that is suitable for use in hand treating laundry items. The use of the water supply circuit 50 with the diverter valve 130 allows a user to selectively dispense water through the faucet 106, independent of operating the washing machine 10 to implement a selected automatic cycle of operation.

The controller 96 can be configured to automatically stop the supply of water to the faucet 106 or to manually stop the supply of water based on input received through the user interface 98. In one example, the supply of water to the faucet 106 may be stopped after a predetermined period of time has elapsed and/or after a predetermined amount of water has been dispensed. The controller 96 can also be configured to actuate the pump 64 to drain the water dispensed by the faucet 106 and collected in the tub 14. The pump 64 can be actuated automatically when the faucet 106 is actuated. In another example, the pump 64 can be actuated based on an amount of water dispensed by the faucet 106. For example, a water level sensor may be configured to detect a level of water in the tub/sump area and the controller 96 may be configured to actuate the pump 64 based on the detected level of water. In another example, the pump 64 can be actuated after a predetermined period of time has elapsed or after a predetermined amount of water has been dispensed by the faucet 106.

Figure 5:
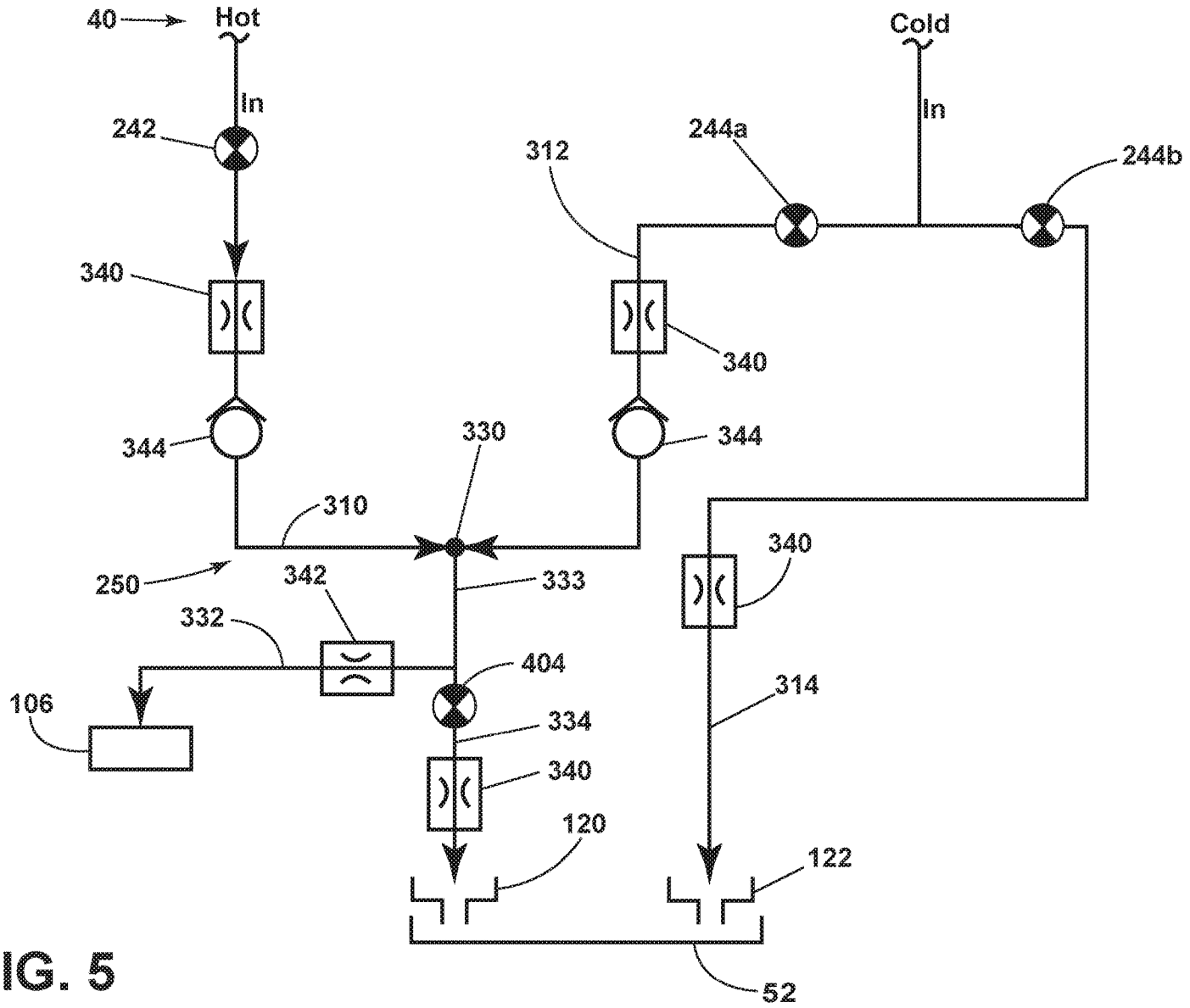
FIG. 5 is a schematic view of a water supply circuit for use with the laundry treating appliance of FIG. 1 according to the present disclosure.

FIG. 5 illustrates another embodiment of a liquid supply system for supplying liquid to the dispenser 52 and the faucet 106 that includes a water supply circuit 250. The water supply circuit 250 utilizes a different configuration of supply conduits and valves to selectively provide water to the faucet 106 without the use of the multi-way diverter valve 130 of FIG. 4. Therefore, elements of the water supply circuit 250 that are similar to the water supply circuit 50 are labeled with similar part numbers increased by 200. The water supply circuit 250 may be used with the washing machine 10 to selectively supply water to the faucet 106.

The liquid supply system includes hot water valve 242 and first and second cold water valves **244*a* and 244*b* controlling a flow of hot and cold water, respectively, from the household water supply 40. The hot water valve 242 controls the flow of hot water from the household water supply 40 to a mixing chamber 330 through the hot water supply conduit 310. The first cold water valve 244*a* is coupled with the first cold water supply conduit 312 to supply cold water to the mixing chamber 330. The second cold water valve 244*b* is coupled with the second cold water supply conduit 314 and supplies cold water to the second treating chemistry reservoir 122**.

As described above with respect to the water supply circuit 50 of FIG. 4, the water supply circuit 250 can optionally include one or more flow restrictors and/or check valves to control the flow of water through the water supply circuit 250. For example, the hot water supply conduit 310, the first cold water supply conduit 312, and the second cold water supply conduit 314 can each include a flow restrictor 340 limiting the flow rate of water through each of the supply conduits 310, 312, and 314. Each of the flow restrictors 340 may restrict the flow rate of water to the same or different flow rates, as needed. One or more check valves 344 can also be provided to prevent water from back flowing to the hot and cold water valves 242, 244*a*, and/or 244*b*. The water supply circuit 250 may include additional or fewer flow restrictors and/or check valves based on the intended use of the water supply circuit 250.

The mixing chamber 330 is fluidly coupled with a supply conduit 333 supplying water to the faucet supply conduit 332 and fluidly coupled with the detergent supply conduit 334 for supplying water to the first treating chemistry reservoir 120. The mixing chamber 330 may be configured as a mixing valve or a chamber defining a space within which water supplied from the hot and first cold water supply conduits 310 and 312 can mix. The detergent supply conduit 334 includes a dispenser valve 404 for selectively controlling the flow of water through the detergent supply conduit 334 to the first treating chemistry reservoir 120.

The faucet supply conduit 332 may include a flow restrictor 342 limiting the flow of water dispensed from the faucet 106 to a predetermined flow rate. In one example, the flow restrictor 342 limits the flow rate of water to a rate suitable for treating laundry items by hand. The flow restrictor 342 optionally limits the flow rate of water to a rate that is less than the flow rate of water supplied to the first treating chemistry reservoir 120 and the second treating chemistry reservoir 122. The detergent supply conduit 334 optionally includes a flow restrictor 340 to limit the flow rate of water supplied to the first treating chemistry reservoir 120 to a predetermined flow rate.

One or more temperature sensors (not shown) may optionally be provided for determining a temperature of the water supplied to the faucet 106 and/or the first treating chemistry reservoir 120. The temperature sensor may be any suitable type of sensor for determining a temperature of the water flowing the supply conduits. Non-limiting examples of temperature sensors include various types of thermocouples, thermometers, or a mechanical thermostats, such as a positive temperature coefficient (PTC) thermistor or a negative temperature coefficient (NTC) thermistor. The temperature sensor(s) may be communicably coupled with the controller 96 to provide information to the controller 96 regarding the temperature of the water flowing through the associated conduit. The controller 96 may be programmed to receive the temperature information as input to a data table or algorithm for determining a ratio of hot and cold water to supply from the household water supply 40 to provide water at a predetermined temperature. The controller 96 may be programmed to control the hot water supply valve 242 and the first cold water supply 244*a* to provide the desired ratio of hot and cold water.

In one example, the controller 96 is programmed to control the hot water supply valve 242 and the first cold water valve 244*a* to provide water to the first treating chemistry reservoir 120 at a predetermined temperature according to an automatic cycle of operation selected by the user through the user interface 98. In another example, the controller 96 is programmed to control the hot water supply valve 42 and the cold water valve 244*a* to provide water to the faucet 106 at a predetermined temperature selected by the user through the user interface 98. In still another example, the controller 96 is programmed to supply water to either or both of the first treating chemistry reservoir 120 and the faucet 106 at a predetermined temperature based on input received through the user interface 98.

Still referring to FIG. 5, the water supply circuit 250 allows a user to utilize the faucet 106 to dispense hot, cold, or warm water independent of an automatic cycle of operation implemented by the washing machine 10. In this manner, the faucet 106 can be used to pre-treat, rinse, or hand-wash a laundry item, for example. The water supply circuit 250 also supplies hot, cold, and warm water to the dispensing system for use in implementing a selected automatic cycle of operation. The water supply circuit 250 includes a series of valves—hot water valve 242, first and second cold water valves 244*a* and 244*b*, and dispenser valve 404—which are controllable by the controller 96 to selectively supply water to the faucet 106, independent of implementing an automatic cycle of operation by the washing machine 10.

A user can select an automatic cycle of operation through the user interface 98 and the controller 96 is configured to control the components of the washing machine 10 to implement the selected automatic cycle of operation. When the selected automatic cycle of operation calls for water to be supplied to the first treating chemistry reservoir 120, the controller 96 controls the hot water valve 242 to supply hot water to the hot water supply conduit 310 and/or controls the first cold water valve 244*a* to supply cold water to the first cold water supply conduit 312.

If the selected automatic cycle of operation calls for only cold water to be supplied to the first treating chemistry reservoir 120, then only the first cold water valve 244*a* is actuated. If the selected automatic cycle of operation calls for only hot water to be supplied to the first treating chemistry reservoir 120, then only the hot water valve 242 is actuated. If the selected automatic cycle of operation calls for warm water, both the hot water valve 242 and the first cold water valves 244*a* are actuated. The controller 96 can be programmed to control the ratio of hot and cold water according to a predetermined algorithm and/or based on data received from a temperature sensor configured to determine the temperature of water supplied to the first treating chemistry reservoir 120.

The hot and/or cold water flows through the hot water supply conduit 310 and/or the first cold water supply conduit 312 to the mixing chamber 330. The mixing chamber 330 is configured to allow the hot and cold water to mix prior to supplying the water to the supply conduit 333. Water supplied to the supply conduit 333 flows through the faucet supply conduit 332 and is dispensed through the faucet 106. The controller 96 actuates the dispenser valve 404 to supply water from the supply conduit 333 to the detergent supply conduit 334 where it is then supplied to the first treating chemistry reservoir 120 according to the selected automatic cycle of operation. In this manner, when water is supplied to the first treating chemistry reservoir 120 in the course of implementing a selected automatic cycle of operation by the washing machine 10, water is also always supplied to the faucet 106. However, water can be selectively supplied only to the faucet 106 by controlling dispenser valve 404.

When the selected automatic cycle of operation calls for water to be supplied to the second treating chemistry reservoir 122, the controller 96 actuates the second cold water valve 244*b* to supply water to the second cold water supply conduit 314, which supplies the cold water to the second treating chemistry reservoir 122.

Still referring to FIG. 5, to use the faucet 106 independent of an automatic cycle of operation implemented by the washing machine 10, the user provides input to the controller 96 through the user interface 98 (FIG. 1) to actuate the faucet 106. The user interface 98 can include a touch screen, push button, knob, or dial which the user can manipulate to turn the faucet 106 on and off independent of selecting an automatic cycle of operation. Optionally, the user interface 98 can be configured to receive input regarding a desired temperature of water to be dispensed by the faucet 106. The user interface 98 can be configured to allow the user to select a desired temperature within a predetermined range of temperatures or to select a temperature from a set of predetermined options, such as hot, cold, and warm. The controller 96 can be programmed to control the ratio of hot and cold water according to a predetermined algorithm and/or based on data received from a temperature sensor configured to determine the temperature of water supplied to the faucet 106.

To supply water to the faucet 106, the controller 96 controls the hot water valve 242 to supply hot water to the hot water supply conduit 310 and/or controls the first cold water valve 244*a* to supply cold water to the first cold water supply conduit 312 based on the temperature selected by the user. The water flows through the hot water supply conduit 310 and/or the cold water supply conduit 312 to the mixing chamber 330. The mixing chamber 330 is configured to allow the hot and cold water to mix prior to supplying the water to the supply conduit 333. Water supplied to the supply conduit 333 flows through the faucet supply conduit 332 and is dispensed through the faucet 106. The dispenser valve 404 remains unactuated and thus water is not supplied to the first treating chemistry reservoir 120. In this manner, water is supplied to the faucet 106 only when requested by a user, independent of an automatic cycle of operation implemented by the washing machine 10.

The controller 96 is configured to actuate one or more of the valves 242, 244*a*, 244*b*, and 404 in various combinations based on the input received through the user interface 98 to actuate the faucet 106 or implement an automatic cycle of operation. For example, the controller 96 is configured to actuate hot water valve 242 to supply hot water to the faucet 106 and first cold water valve 244*a* to supply cold water to the faucet 106. To supply warm water to the faucet 106, the controller 96 is configured to actuate the hot water valve 242 and the first cold water valve 244*a*.

The controller 96 is also configured to actuate hot water valve 242, first cold water valve 244*a*, and dispenser valve 404 to supply warm water to the first treating chemistry reservoir 120 during implementation of a selected automatic cycle of operation. The controller 96 is configured to actuate hot water valve 242 and dispenser valve 404 to supply hot water to the first treating chemistry reservoir 120 and to actuate the first cold water valve 244*a* and the dispenser valve 404 to supply cold water to the first treating chemistry reservoir 120. The water supply circuit 250 is configured such that whenever water is supplied to the first treating chemistry reservoir 120, water is also supplied to the faucet 106. In one example, the flow rate of water to the faucet 106 is less than the flow rate of water to the first treating chemistry reservoir 120 and does not negatively impact dispensing from the first treating chemistry reservoir 120. The water flowing through the faucet 106 is supplied to the drum 16 from which it flows to the tub 14 where it may be utilized in implementing the automatic cycle of operation, as needed.

The water supply circuit 250 utilizes a combination of valves 242, 244*a*, 244*b*, and 404 positioned throughout the water supply circuit 250 to control the flow of water to selectively supply water to the faucet 106, independent of an automatic cycle of operation implemented by the washing machine 10. Multiple valves can be configured in a particular pattern or array, such as that illustrated in FIG. 5, to control the flow of water to the faucet 106 without the use of a multi-way diverter valve, such as the diverter valve 130 described with respect to the embodiment of FIG. 4. Multi-way diverter valves can be more expensive and/or may utilize more energy in operation than a configuration that relies on multiple valves, such as that illustrated in FIG. 5. In addition, a multi-way diverter valve may require additional or more complex programming to the controller 96 than the array of valves of water supply circuit 250. One example of a type of valve suitable for use in the water supply circuit 250 is a pilot valve. The combination of pilot valves in the water supply circuit 250 can provide a more cost effective and simpler to control water supply circuit than one which utilizes a multi-way diverter valve. Pilot valves may also optionally be used in the water supply circuit 50, in combination with the diverter valve 130.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described. For example, components of the water supply circuit 50 and water supply circuit 250 can be combined in various combinations to form additional examples of hydraulic assemblies to selectively supplying water to the faucet 106 independent of an automatic cycle of operation implemented by the washing machine 10 without deviating from the scope of the present disclosure.

While the present disclosure has been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A laundry treating appliance comprising:

a treating chamber receiving laundry for treatment;

a dispenser having at least a first and second treating chemistry reservoir fluidly coupled to the treating chamber;

a faucet having an outlet fluidly coupled to the treating chamber; and a water supply circuit comprising:

a mixing chamber;

a cold water inlet;

a hot water inlet;

a first cold water supply conduit fluidly coupling the cold water inlet to the mixing chamber;

a second cold water supply conduit bypassing the mixing chamber and fluidly coupling the cold water inlet to the second treating chemistry reservoir;

a hot water supply conduit fluidly coupling the hot water inlet to the mixing chamber;

a supply conduit fluidly coupled to the mixing chamber;

a faucet supply conduit fluidly coupling the supply conduit to the faucet, and without a controllable valve provided along the faucet supply conduit;

a detergent supply conduit fluidly coupling the supply conduit to the first treating chemistry reservoir, with a dispenser valve fluidly coupled to and controlling a flow of water through the detergent supply conduit;

wherein the supply conduit and the faucet supply conduit define a direct fluid coupling from the mixing chamber to the faucet; and a controller configured to operate the laundry treating appliance according to a cycle of operation, the controller being further operably coupled to the water supply circuit and configured to actuate the dispenser valve to selectively supply water leaving the mixing chamber through the supply conduit to the detergent supply conduit;

wherein the water leaving the mixing chamber is supplied to the faucet during the cycle of operation or by request of a user through the controller, such that the water leaving the mixing chamber is supplied to the faucet.

2. The laundry treating appliance of claim 1, further comprising a user interface configured to receive as input a selected temperature of water to supply to the faucet.

3. The laundry treating appliance of claim 2, wherein the controller is communicably coupled with the user interface and configured to selectively control a ratio of hot and cold water supplied to the faucet based on input to the user interface.

4. The laundry treating appliance of claim 1, wherein the water supply circuit comprises an array of pilot valves controlling a flow of water through the hot water supply conduit and the first and second cold water supply conduits.

5. The laundry treating appliance of claim 1, further comprising a door movable to selectively close the treating chamber in a closed position and to provide access to the treating chamber in an open position, wherein the faucet becomes accessible when the door is in the open position.

6. The laundry treating appliance of claim 1, wherein the water supply circuit further comprises at least one temperature sensor for sensing a temperature of water supplied to at least one of the faucet, the first treating chemistry reservoir, or both.

7. The laundry treating appliance of claim 1, wherein the water supply circuit is configured to selectively supply water to the faucet independent of supplying water to the first and second treating chemistry reservoirs during an automatic cycle of operation.

8. The laundry treating appliance of claim 7, wherein the water supply circuit supplies water to the faucet when water is supplied to the first treating chemistry reservoir during the automatic cycle of operation.

9. The laundry treating appliance of claim 1, wherein water is only supplied to the at least one of the first and second treating chemistry reservoirs when water is supplied to the faucet.

10. The laundry treating appliance of claim 1, wherein water is always supplied to the faucet when water is supplied to the at least one of the first and second treating chemistry reservoirs.

11. The laundry treating appliance of claim 1, wherein the supply conduit is provided upstream of both the faucet supply conduit and the detergent supply conduit to fluidly couple both the faucet supply conduit and the detergent supply conduit to the mixing chamber.

12. The laundry treating appliance of claim 11, wherein the dispenser valve selectively fluidly couples the supply conduit to the detergent supply conduit downstream of the coupling of the supply conduit with the faucet supply conduit.

13. The laundry treating appliance of claim 12, wherein the supply conduit supplies hot water, cold water, or a mixture of hot and cold water from the mixing chamber to both the faucet supply conduit and the dispenser valve.

14. The laundry treating appliance of claim 13, wherein water is only supplied to the dispenser valve when water is supplied to the faucet.

15. The laundry treating appliance of claim 14, wherein the water leaving the mixing chamber is always supplied to the faucet when water is supplied to the dispenser valve.

16. The laundry treating appliance of claim 1, wherein the first cold water supply conduit includes a first cold water valve to selectively supply cold water to the mixing chamber.

17. The laundry treating appliance of claim 1, wherein the second cold water supply conduit includes a second cold water valve to selectively supply cold water to the second treating chemistry reservoir.

18. The laundry treating appliance of claim 1, wherein the dispenser is configured to dispense water from at least one of the first chemistry treating reservoir and the second chemistry treating reservoir.

* * * * *